United States Patent [19]

Hidan

[11] 4,091,126

[45] May 23, 1978

[54] METHOD OF DYEING A PATTERN LIKE THE GRAIN OF WOOD ON THE SURFACE OF AN ALUMINUM

[75] Inventor: Hiroshi Hidan, Kashiwa, Japan

[73] Assignee: Kabushiki Kaisha Hidan Seisakusho, Japan

[21] Appl. No.: 664,382

[22] Filed: Mar. 5, 1976

[51] Int. Cl.[2] ..... B05D 1/36; B05D 5/00

[52] U.S. Cl. ..... 427/262; 118/402; 148/6.1; 204/35 N; 427/419 G; 427/434 A; 428/106

[58] Field of Search ..... 118/402; 148/6.1; 204/35 N; 427/262, 419 G, 434 A; 428/106

[56] References Cited

U.S. PATENT DOCUMENTS

| | | | |
|---|---|---|---|
| 1,930,036 | 10/1933 | Bracewell | 427/434 X |
| 3,291,651 | 12/1966 | Drassel | 148/6.1 |
| 3,407,098 | 10/1968 | Hurley et al. | 148/6.1 |
| 3,418,219 | 12/1968 | Fahlbush | 204/35 X |
| 3,423,251 | 1/1969 | Metcalfe et al. | 148/6.1 |
| 3,440,111 | 4/1969 | Dale | 204/35 X |
| 3,468,767 | 9/1969 | Anderson et al. | 204/35 X |
| 3,709,742 | 1/1973 | Jacobs | 148/6.1 |
| 3,718,548 | 2/1973 | Paulet et al. | 204/35 N |
| 3,917,887 | 11/1975 | Stiller | 148/6.1 X |

*Primary Examiner*—Michael R. Lusignan
*Attorney, Agent, or Firm*—Robert E. Burns; Emmanuel J. Lobato; Bruce L. Adams

[57] ABSTRACT

Method of dyeing a pattern analogous to the grain of wood onto the surface of a blank consisting of aluminum or alloys thereof having a film of anodic oxidation thereon. A coloring composition containing oil dye is dropped on a water surface to diffuse, distribute or spread the coloring composition on the water surface in a patterned manner. The surface to be dyed of the blank is brought into contact in flat or inclined fashion with the patterned composition on the water surface to thereby adsorb coloring components into pin holes in the surface. The water surface is a stationary water surface or a flowing water surface.

5 Claims, No Drawings

METHOD OF DYEING A PATTERN LIKE THE GRAIN OF WOOD ON THE SURFACE OF AN ALUMINUM

This invention relates to a method of dyeing a pattern resembling or analogous to the grain of wood onto a shaped object surface of a blank, such as plates or other formed articles, consisting of aluminum or aluminum alloys.

It is known that the surface of metal in the group of aluminum treated with anodic oxidation is coated with a film oxide formed with a number of minute pin holes, the oxide film readily receiving the oil dye. Thus, in the past simple apparatus and method have been used for purposes of dyeing the surface of aluminum blank and depicting a pattern on the surface thereof, and resultant products are frequently used as an interior finish material for buildings or vehicles and as a casing for electrical instruments for home-use. While the pattern like the grain of wood formed on a printing surface of aluminum may easily be obtained by the press such as an offset press, the products resulted therefrom are uniform since they are pictures transferred from a printing cylinder. As wood is normally individually different in section, a requirement desired to dye a distinctive pattern like the grain of wood onto the surface of an aluminum blank occurs in the case where the products resulted therefrom are used, for example, for wall plates for buildings. In such application, several sheets of elements are aligned, as a consequence of which ornamental interest is lost if they are identical or limited in kinds of pattern resembling the grain of differently patterned wood. Preparing a variety of printing therefrom cylinders and printing by replacing the cylinders in order to increase the variety of patterns resembling the grain of wood obviously result in an increase in cost.

It is therefore an object of the present invention to provide a novel method of dyeing a pattern like the grain of wood on the surface of an aluminum blank, in which products resulted therefrom exhibit a distinct varied pattern like the grain of wood with from one another.

It is an essential object of the invention to provide a method of ornamenting the surface of an aluminum blank, which is simple in apparatus and process used and can be embodied at a relatively low cost.

It is another object of the invention to provide a method of depicting a pattern on the surface of an aluminum blank, which can be embodied even if the blank has a curved surface or a solid surface without limiting in its shape to a plane plate.

According to features of the dyeing method of the present invention, a coloring composition containing an oil dye is deposited by dropping or pouring onto the water surface in a water tank and spreads thereon, and an aluminum blank having a film of anodic oxidation is impregnated or brought into contact with the water surface upon which the coloring composition is spread on diffused in a pattern resembling wood grain. The coloring composition used in this method includes a vehicle and a solvent as well as a known oil dye for dyeing aluminum. The solvent itself may be known matter but should have, when the coloring composition is dropped into the water surface, the function to control the operation in which the oil dye is diffused or spread on the water surface. That is, the kind and quantity of the solvent are related to situation of density and distribution of patterns like the grain of wood obtained according to the present invention. Although not in a sense of limitation, for example, used jointly with a water soluble organic solvent are oil groups such as turpentine oil, long chain fatty acids such as oleic acid, or long chain alcohols such as hexylalcohol.

In the embodiment of the dyeing method according to the present invention, water within the water tank is soft water, which may have either a stationary water surface or a flowing water surface. The aluminum blank is placed in contact with the water surface with the patterned coloring composition diffused thereon, orientation of the blank may be varied. That is, one orientation is such that the surface to be dyed of the blank is in a flat parallel configuration with respect to the water surface, whereas other orientations such that the surface to be dyed is inclined or offset configurations with respect to the water surface. Where the surface of an aluminum blank is brought into contact with the water surface while being offset, and if the water surface has a flowing water surface, consideration may be made such that the blank surface is offset with respect to the direction of flow thereof. While various elements, herein described, influence on a finished condition of patterns like the grain of wood to be dyed on the surface of the aluminum blank, patterns like the grain of wood, different from one another, may be obtained even if one of those elements noted above should be varied. After all, according to the present invention, distinct patterns like the grain of wood, different from one another, may be dyed on a variety of aluminum blanks depending upon kind and quantity of solvent for the coloring composition, conditions of the water surface, the velocity if flow is present, and the orientation of the aluminum blank when the latter placed in contact with the spread composition pattern on the water surface. These patterns resembling the grains of wood may further be increased in variety by varying the drop quantity of coloring composition, color tone and or density of the oil dye.

According to a preferred embodiment of the dyeing method of the present invention, it is designed, so that when the top layer of water within the water tank is totally and slowly flowing from one edge toward the other of the water tank, to drop the coloring composition at an upstream portion of the flowing water surface, after which the surface to be dyed of the aluminum blank is brought into contact with the composition diffusd on the water surface while it is flowing downstream. In this manner, beautiful patterns resembling the grain of wood along the straight grain can be obtained. According to treatment of the flowing water surface, an excessive portion of the dropped coloring composition, that is, the residual coloring composition dyed on the blank flows out, and hence, it will not influence the operation of dyeing another subsequent blank. According to this method, therefore, the method may also be embodied by varying color of the coloring composition every one drop.

According to a practical embodiment, the aluminum blank after being dyed causes the dyed coloring component to seal the pin holes in a known manner. In this manner, patterns like the grain of wood, which are beautiful and not skived, may substantially permanently dyed on the surface of the aluminum blank.

In the following, several examples of coloring compositions used in the dyeing method according to the present invention and the results obtained by the use of these coloring compositions will be given. Is is to be noted that components of respective coloring compositions are represented by capacity ratio.

EXAMPLE 1

| | |
|---|---|
| Oil dye (red) | Suitable amount |
| Vehicle (printing ink vehicle) | 1 |
| Aluminum acetate | 1 - 2 |
| Solvent naphtha | 1 |
| Slowly drying solvent | 3 |

Light and shade thick and thin lines are mixed and spread over the water surface, from the top of which a blank is immersed, and then, graceful patterns like the grain of wood are dyed on the surface thereof.

EXAMPLE 2

| | |
|---|---|
| Oil dye (red) | Suitable amount |
| Vehicle | 1 |
| Oleic acid | 2 - 5 |
| Ethyl acetate | 1 - 3 |

The dye is spread in netted fashion on the water surface, from which a blank is immersed, and then, patterns like the grain of wood analogous to the meshes of a net are dyed on the surface thereof. These patterns may variously be varied into thin meshes, thick and coarse meshed or the like by variously changing the aforesaid combination ratio or by further adding alcohol thereto.

EXAMPLE 3

| | |
|---|---|
| Oil dye (brown) | Suitable amount |
| Vehicle | 3 |
| Aluminum acetate | 4 |
| Slowly drying solvent | 1 |

The dye is thinly diffused over the entire water surface, into which relatively thick and shade lines are formed. When a blank is immersed therein, the coarse grain of wood is dyed.

EXAMPLE 4

| | |
|---|---|
| Oil dye (blue) | Suitable amount |
| Vehicle | 1 |
| Turpentine oil | 2 |
| Aluminum acetate | 2 |

Extremely thin, dense and irregular rings are spread over the water surface, and when a blank is immersed, minute patterns like the grain of wood may be obtained on the surface thereof.

EXAMPLE 5

| | |
|---|---|
| Oil dye (black) | Suitable amount |
| Aluminum acetate | 1 - 2 |
| Diethylphthalate | 3 - 4 |
| Vehicle | 1 |

The dye is thinly spread over the entire water surface, into which thin and shade lines are spread. When a blank is immersed, relatively thin patterns like the grain of wood may be obtained.

What is claimed is:

1. A method of dyeing a pattern resembling wood grain upon the surfaces of formed blanks of anodic oxide film-coated aluminum or alloys thereof which comprises the steps of depositing in a patterned manner unto the surface of the water on a water tank an oily coloring composition containing an oil dye, a vehicle therefore and a solvent, said solvent being selected from the group consisting of a water soluble organic solvent and one or more of an oil group long chain fatty acid and a long chain alcohol; contacting said formed blank with the water surface bearing said deposited composition to transfer the deposited patterned oily composition from said surface to said anodic oxide film on said blank.

2. The method according to claim 1, wherein the surface to be dyed of said blank is contacted in a flat fashion with said patterned water surface.

3. The method according to claim 1, wherein the surface to be dyed of said blank is contacted in an inclined fashion with said patterned water surface.

4. The method according to claim 1, wherein said water surface is a stationary water surface.

5. The method according to claim 1, wherein said water surface is a flowing water surface.

* * * * *